US010984714B2

(12) United States Patent
Xu et al.

(10) Patent No.: US 10,984,714 B2
(45) Date of Patent: Apr. 20, 2021

(54) METHOD AND APPARATUS OF COMPENSATING DISPLAY DEVICE, AND DISPLAY DEVICE

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Haixia Xu, Beijing (CN); Zhidong Yuan, Beijing (CN); Min He, Beijing (CN); Wei Chen, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/714,498

(22) Filed: Dec. 13, 2019

(65) Prior Publication Data

US 2020/0202778 A1 Jun. 25, 2020

(30) Foreign Application Priority Data

Dec. 24, 2018 (CN) ..... 201811583443.2

(51) Int. Cl.
*G09G 5/10* (2006.01)
*G09G 3/3233* (2016.01)
*G09G 3/20* (2006.01)

(52) U.S. Cl.
CPC ..... *G09G 3/3233* (2013.01); *G09G 3/2003* (2013.01); *G09G 3/2074* (2013.01);
(Continued)

(58) Field of Classification Search
CPC .... G09G 3/006; G09G 3/2003; G09G 3/2074; G09G 3/3208; G09G 3/3233;
(Continued)

(56) References Cited

U.S. PATENT DOCUMENTS 8,274,462 B2 9/2012 Okuyama et al.
9,111,485 B2 * 8/2015 Chaji ..... G09G 3/3208
(Continued)

FOREIGN PATENT DOCUMENTS

CN 101308641 A 11/2008
CN 104715720 A 6/2015
(Continued)

OTHER PUBLICATIONS

First Office Action for Chinese Application No. 201811583443.2, dated Jan. 2, 2020, 8 Pages.

*Primary Examiner* — Joe H Cheng
(74) *Attorney, Agent, or Firm* — Brooks Kushman P.C.

(57) ABSTRACT

A method and an apparatus of compensating a display device, and the display device are provided. The display device includes pixel units in multiple rows and multiple columns, each of the pixel units includes sub-pixels having different colors, and each of the sub-pixels includes a pixel driving circuit and a light-emitting element connected to the pixel driving circuit, the pixel driving circuit includes a sensing line for sensing an electrical signal from the light-emitting element. The method includes: sensing electrical signals from light-emitting elements of sub-pixels having at least two different colors by using sensing lines corresponding to the sub-pixels having the at least two different colors within a display period of each image frame, wherein the subpixels having the at least two different colors are within different pixel units of the pixel units.

8 Claims, 3 Drawing Sheets

(52) U.S. Cl.
CPC ..... *G09G 2300/0452* (2013.01); *G09G 2320/0233* (2013.01); *G09G 2320/045* (2013.01)

(58) Field of Classification Search
CPC ... G09G 2300/0452; G09G 2320/0233; G09G 2320/045
See application file for complete search history.

(56) References Cited

U.S. PATENT DOCUMENTS

| | | | | |
|---|---|---|---|---|
| 10,403,190 | B2 * | 9/2019 | Han | G09G 5/10 |
| 2008/0284768 | A1 | 11/2008 | Yoshida et al. | |
| 2009/0295839 | A1 * | 12/2009 | Furukawa | G09G 3/3611 345/690 |
| 2011/0062874 | A1 * | 3/2011 | Knapp | H04L 12/437 315/158 |
| 2012/0299973 | A1 * | 11/2012 | Jaffari | G09G 3/3258 345/690 |
| 2013/0112960 | A1 * | 5/2013 | Chaji | H01L 51/5271 257/40 |
| 2015/0035735 | A1 * | 2/2015 | Kang | G09G 3/3291 345/77 |
| 2015/0170578 | A1 | 6/2015 | Choi | |
| 2016/0005354 | A1 | 1/2016 | Takasugi et al. | |
| 2016/0329016 | A1 * | 11/2016 | Chaji | G09G 3/3225 |
| 2018/0018916 | A1 | 1/2018 | Chung | |
| 2019/0066591 | A1 | 2/2019 | Xu et al. | |
| 2019/0259327 | A1 * | 8/2019 | Li | G09G 3/3225 |

FOREIGN PATENT DOCUMENTS

| | | | |
|---|---|---|---|
| CN | 105118442 | A | 12/2015 |
| CN | 105261330 | A | 1/2016 |
| CN | 107393469 | A | 11/2017 |

* cited by examiner

METHOD AND APPARATUS OF COMPENSATING DISPLAY DEVICE, AND DISPLAY DEVICE

CROSS-REFERENCE TO RELATED APPLICATION

This application claims priority to Chinese Patent Application No. 201811583443.2 filed on Dec. 24, 2018, which is incorporated herein by reference in its entirety.

TECHNICAL FIELD

The present disclosure relates to the field of display technology, and in particular to a method and an apparatus of compensating a display device, and a display device.

BACKGROUND

In a pixel of a related Organic Light Emitting Diode (OLED) display, a driving transistor is usually made of a semiconductor material such as amorphous silicon, polysilicon, or metal oxide. Due to limitation from a manufacturing process, the driving transistor of the pixel of the OLED display often exhibits fluctuations in electrical parameters such as a threshold voltage Vth, a mobility K, and so on. Such fluctuations may be converted into current variations and brightness variations of the OLED display perceived by human eyes.

SUMMARY

The present disclosure provides a method of compensating a display device, an apparatus of compensating a display device, and a display device.

In a first aspect, a method of compensating a display device is provided in the present disclosure, wherein the display device includes a plurality of pixel units arranged in multiple rows and multiple columns, each of the plurality of pixel units includes a plurality of sub-pixels having different colors, and each of the plurality of sub-pixels includes a pixel driving circuit and a light-emitting element connected to the pixel driving circuit, the pixel driving circuit includes a sensing line for sensing an electrical signal from the light-emitting element. The method includes: sensing electrical signals from light-emitting elements of sub-pixels having at least two different colors by using sensing lines corresponding to the sub-pixels having the at least two different colors within a display period of each image frame, wherein the subpixels having the at least two different colors are within different pixel units of the plurality of pixel units.

Optionally, each of the plurality of pixel units includes sub-pixels having N different colors, N is an integer greater than 1; sensing electrical signals from light-emitting elements of sub-pixels having at least two different colors by using sensing lines corresponding to the sub-pixels having the at least two different colors within a display period of each image frame, includes: within the display period of each image frame, sensing electrical signals from light-emitting elements of sub-pixels having N different colors in pixel units in a same row, by using sensing lines corresponding to the sub-pixels having N different colors.

Optionally, within the display period of each image frame, sensing electrical signals from light-emitting elements of sub-pixels having N different colors in pixel units in a same row, by using sensing lines corresponding to the sub-pixels having N different colors, specifically includes: in a display period of a first image frame in display periods of N image frames, sensing an electrical signal from a light-emitting element of a first-color sub-pixel in a (N*k+1)-th pixel unit in a m-th row, an electrical signal from a light-emitting element of a second-color sub-pixel in a (N*k+2)-th pixel unit in the m-th row, . . . , and an electrical signal from a light-emitting element of a (N-th)-color sub-pixel in a (N*k+N)-th pixel unit in the m-th row, wherein k is an integer not less than 0, and m is a positive integer; in a display period of a second image frame in the display periods of the N image frames, sensing an electrical signal from a light-emitting element of a second-color sub-pixel in a (N*k+1)-th pixel unit in a (m+1)-th row, . . . , an electrical signal from a light-emitting element of a N-th-color sub-pixel in a (N*k+N−1)-th pixel unit in the (m+1)-th row, and an electrical signal from a light-emitting element of a first-color sub-pixel in a (N*k+N)-th pixel unit in the (m+1)-th row; in a display period of a p-th image frame in the display periods of the N image frames, sensing an electrical signal from a light-emitting element of a p-th-color sub-pixel in a (N*k+1)-th pixel unit in a (m+p−1)-th row, . . . , an electrical signal from a light-emitting element of a (p−1+q−1)-th sub-pixel in a (N*k+q)-th pixel unit in the (m+p−1)-th row, . . . , and an electrical signal from a light-emitting element of a (p−1)-th-color sub-pixel in a (N*k+N)-th pixel unit in the (m+p−1)-th row, wherein, p and q are integers greater than or equal to 1 and less than or equal to n, and i=0 in a case that p+q≤N+1, and i=N in a case that p+q>N+1; and in a display period of a N-th image frame in the display periods of the N image frames, sensing an electrical signal from a light-emitting element of a N-th-color sub-pixel in a (N*k+1)-th pixel unit in a (m+N−1)-th row, an electrical signal from a light-emitting element of a first-color sub-pixel in a (N*k+2)-th pixel unit in the (m+N−1)-th row, and an electrical signal from a light-emitting element of a (N−1)-th-color sub-pixel in a (N*k+N)-th pixel unit in the (m+N−1)-th row.

Optionally, each of the plurality of pixel units includes a red sub-pixel, a green sub-pixel, a blue sub-pixel, and a white sub-pixel, the method specifically includes: in a display period of a first image frame in display periods of four image frames, sensing an electrical signal from a light-emitting element of a red sub-pixel in a (4k+1)-th pixel unit in a m-th row, an electrical signal from a light-emitting element of a green sub-pixel in a (4k+2)-th pixel unit in the m-th row, an electrical signal from a light-emitting element of a blue sub-pixel of a (4k+3)-th pixel unit in the m-th row, and an electrical signal of a light-emitting element of a white sub-pixel in a (4k+4)-th pixel unit in the m-th row; in a display period of a second image frame in the display periods of the four image frames, sensing an electrical signal from a light-emitting element of a green sub-pixel in a (4k+1)-th pixel unit in a (m+1)-th row, an electrical signal from a light-emitting element of a blue sub-pixel in a (4k+2)-th pixel unit in the (m+1)-th row, an electrical signal from a light-emitting element of a white sub-pixel of a (4k+3)-th pixel unit in the (m+1)-th row, and an electrical signal of a light-emitting element of a red sub-pixel in a (4k+4)-th pixel unit in the (m+1)-th row; in a display period of a third image frame in the display periods of the four image frames, sensing an electrical signal from a light-emitting element of a blue sub-pixel in a (4k+1)-th pixel unit in a (m+2)-th row, an electrical signal from a light-emitting element of a white sub-pixel in a (4k+2)-th pixel unit in the (m+2)-th row, an electrical signal from a light-emitting element of a red sub-pixel of a (4k+3)-th pixel unit in the (m+2)-th row, and an electrical signal of a light-emitting element of a green sub-pixel in a (4k+4)-th pixel unit in the (m+2)-th row; in a display period of a fourth image frame in the display periods of the four image frames, sensing an electrical signal from a light-emitting element of a white sub-pixel in a (4k+1)-th pixel unit in a (m+3)-th row, an electrical signal from a light-emitting element of a red sub-pixel in a (4k+2)-th pixel unit in the (m+3)-th row, an electrical signal from a light-emitting element of a green sub-pixel of a (4k+3)-th pixel unit in the (m+3)-th row, and an electrical signal of a light-emitting element of a blue sub-pixel in a (4k+4)-th pixel unit in the (m+3)-th row.

Optionally, a value of m may be any multiple of N plus 1.

Optionally, the sensed sub-pixels in two adjacent rows of pixel units are in different columns, or the sensed sub-pixels in three adjacent rows of pixel units are in different columns; the sensed sub-pixels in four adjacent rows of pixel units are in different columns.

In a second aspect, an apparatus of compensating a display device is provided in the present disclosure. The display device includes a plurality of pixel units arranged in multiple rows and multiple columns, each of the plurality of pixel units includes a plurality of sub-pixels having different colors, and each of the plurality of sub-pixels includes a pixel driving circuit and a light-emitting element connected to the pixel driving circuit, the pixel driving circuit includes a sensing line for sensing an electrical signal from the light-emitting element. The apparatus includes: a sensing circuit, connected to the sensing line and configured to sense electrical signals from light-emitting elements of sub-pixels having at least two different colors by using sensing lines corresponding to the sub-pixels having the at least two different colors within a display period of each image frame, wherein the subpixels having the at least two different colors are within different pixel units of the plurality of pixel units.

Optionally, each of the plurality of pixel units includes sub-pixels having N different colors, N is an integer greater than 1; the sensing circuit is specifically configured to: within the display period of each image frame, sense electrical signals from light-emitting elements of sub-pixels having N different colors in pixel units in a same row, by using sensing lines corresponding to the sub-pixels having N different colors.

Optionally, the sensing circuit is specifically configured to: in a display period of a first image frame in display periods of N image frames, sense an electrical signal from a light-emitting element of a first-color sub-pixel in a (N*k+1)-th pixel unit in a m-th row, an electrical signal from a light-emitting element of a second-color sub-pixel in a (N*k+2)-th pixel unit in the m-th row, and an electrical signal from a light-emitting element of a (N-th)-color sub-pixel in a (N*k+N)-th pixel unit in the m-th row, wherein k is an integer not less than 0, and m is a positive integer; in a display period of a second image frame in the display periods of the N image frames, sense an electrical signal from a light-emitting element of a second-color sub-pixel in a (N*k+1)-th pixel unit in a (m+1)-th row, . . . , an electrical signal from a light-emitting element of a N-th-color sub-pixel in a (N*k+N−1)-th pixel unit in the (m+1)-th row, and an electrical signal from a light-emitting element of a first-color sub-pixel in a (N*k+N)-th pixel unit in the (m+1)-th row; in a display period of a p-th image frame in the display periods of the N image frames, sense an electrical signal from a light-emitting element of a p-th-color sub-pixel in a (N*k+1)-th pixel unit in a (m+p−1)-th row, . . . , an electrical signal from a light-emitting element of a (p−1+q−i)-th sub-pixel in a (N*k+q)-th pixel unit in the (m+p−1)-th row, . . . , and an electrical signal from a light-emitting element of a (p−1)-th-color sub-pixel in a (N*k+N)-th pixel unit in the (m+p−1)-th row, wherein, p and q are integers greater than or equal to 1 and less than or equal to n, and i=0 in a case that p+q≤N+1, and i=N in a case that p+q>N+1; and in a display period of a N-th image frame in the display periods of the N image frames, sense an electrical signal from a light-emitting element of a N-th-color sub-pixel in a (N*k+1)-th pixel unit in a (m+N−1)-th row, an electrical signal from a light-emitting element of a first-color sub-pixel in a (N*k+2)-th pixel unit in the (m+N−1)-th row, . . . , and an electrical signal from a light-emitting element of a (N−1)-th-color sub-pixel in a (N*k+N)-th pixel unit in the (m+N−1)-th row.

Optionally, each of the plurality of pixel units includes a red sub-pixel, a green sub-pixel, a blue sub-pixel, and a white sub-pixel, the sensing circuit is specifically configured to: in a display period of a first image frame in display periods of four image frames, sense an electrical signal from a light-emitting element of a red sub-pixel in a (4k+1)-th pixel unit in a m-th row, an electrical signal from a light-emitting element of a green sub-pixel in a (4k+2)-th pixel unit in the m-th row, an electrical signal from a light-emitting element of a blue sub-pixel of a (4k+3)-th pixel unit in the m-th row, and an electrical signal of a light-emitting element of a white sub-pixel in a (4k+4)-th pixel unit in the m-th row; in a display period of a second image frame in the display periods of the four image frames, sense an electrical signal from a light-emitting element of a green sub-pixel in a (4k+1)-th pixel unit in a (m+1)-th row, an electrical signal from a light-emitting element of a blue sub-pixel in a (4k+2)-th pixel unit in the (m+1)-th row, an electrical signal from a light-emitting element of a white sub-pixel of a (4k+3)-th pixel unit in the (m+1)-th row, and an electrical signal of a light-emitting element of a red sub-pixel in a (4k+4)-th pixel unit in the (m+1)-th row; in a display period of a third image frame in the display periods of the four image frames, sense an electrical signal from a light-emitting element of a blue sub-pixel in a (4k+1)-th pixel unit in a (m+2)-th row, an electrical signal from a light-emitting element of a white sub-pixel in a (4k+2)-th pixel unit in the (m+2)-th row, an electrical signal from a light-emitting element of a red sub-pixel of a (4k+3)-th pixel unit in the (m+2)-th row, and an electrical signal of a light-emitting element of a green sub-pixel in a (4k+4)-th pixel unit in the (m+2)-th row; in a display period of a fourth image frame in the display periods of the four image frames, sense an electrical signal from a light-emitting element of a white sub-pixel in a (4k+1)-th pixel unit in a (m+3)-th row, an electrical signal from a light-emitting element of a red sub-pixel in a (4k+2)-th pixel unit in the (m+3)-th row, an electrical signal from a light-emitting element of a green sub-pixel of a (4k+3)-th pixel unit in the (m+3)-th row, and an electrical signal of a light-emitting element of a blue sub-pixel in a (4k+4)-th pixel unit in the (m+3)-th row.

Optionally, the sensed sub-pixels in two adjacent rows of pixel units are in different columns, or the sensed sub-pixels in three adjacent rows of pixel units are in different columns; the sensed sub-pixels in four adjacent rows of pixel units are in different columns.

In a third aspect, a display device is provided in the present disclosure. The display device includes the apparatus of compensating the display device according to the second aspect.

DETAILED DESCRIPTION

Figure 1:
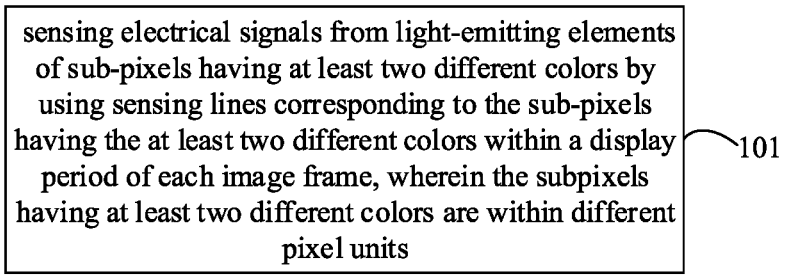
FIG. 1 is a flow chart of a method of compensating a display device provided by the present disclosure.

In order to make a technical problem, a technical solution and an advantage to be solved by the embodiments of the present disclosure clearer, the embodiments of the present disclosure will be described in detail with reference to the accompanying drawings hereinafter.

Due to limitation of a process of manufacturing a pixel of an Organic Light Emitting Diode (OLED) display device, a driving transistor of a pixel of the OLED display device often exhibits fluctuations in electrical parameters such as a threshold voltage Vth, a mobility K, and so on. Such fluctuations may be converted into current variations and brightness variations of the OLED display device perceived by human eyes. During using the OLED display device, the threshold voltage of the drive transistor may also drift. Since pictures displayed at different positions of the OLED display device are different, drafting amounts of driving transistors at different portions of the OLED display device are different, and thus result in a difference in display brightnesses at different portions. Since this difference is related to a previously displayed image, it is often exhibited as an afterimage phenomenon which is commonly referred to as an afterimage.

To solve a problem of the afterimage, a threshold compensation and a mobility compensation for driving transistors of pixels in the OLED display device may be realized by sensing a current or a voltage for driving the OLED to emit light. When this compensation is to be adopted, it is necessary to set a sensing line for sensing the current or the voltage of the OLED.

When the current or the voltage is sensed by the sensing line, only sub-pixels having one color in a row of pixel units are sensed in a display period of a frame, and sub-pixels having the one color in a next row of pixel units are sensed in a next display period of a frame. Sub-pixels having a different color are sensed after sub-pixels having the one color in all rows of pixel units are sensed. If a display device has A rows of pixel units, and each pixel unit has sub-pixels having B types of colors, it takes a/m seconds to finish a process of sensing all sub-pixels having a same color, and a*b/m seconds to finish processes of sensing all sub-pixels in the display device, where m is a refresh frequency. Both the a/m seconds and the a*b/m seconds are long durations. In addition, because only sub-pixels having one color are sensed in a long duration, an effect of compensating the afterimage is limited. In addition, because a distribution of sub-pixels having a same color is concentrated, the sensed sub-pixels are also concentrated. Thus, noise in a sensing process is also relatively concentrated when an image is switched, and therefore, a sensing value will be influenced, thereby generating a cross-cut pattern and affecting a display effect. Since a duration of sensing only sub-pixels having a same color is long, and the distribution of the sensed sub-pixels is concentrated, heat generated when the display device displays is also relatively focused, it is easy for human eyes to recognize aging of a screen caused by a temperature rise, and the display effect may also be affected.

In order to solve the above problems, embodiments of the present disclosure provide a method of compensating a display device, an apparatus of compensating a display device, and a display device, and may improve the effect of compensating an afterimage and improve a display effect of the display device.

FIG. 1 is a flow chart of a method of compensating a display device provided by the present disclosure. The display device includes a plurality of pixel units arranged in multiple rows and multiple columns. Each pixel unit includes a plurality of sub-pixels having different colors, and each sub-pixel includes a pixel driving circuit 10 and a light-emitting element 11 connected to the pixel driving circuit 10. The pixel driving circuit 10 includes a sensing line GC for sensing an electrical signal from the light-emitting element. As shown in FIG. 1, the method of compensating the display device includes a step 101.

Step 101: sensing electrical signals from light-emitting elements of sub-pixels having at least two different colors by using sensing lines corresponding to the sub-pixels having the at least two different colors within a display period of each image frame, wherein the subpixels having at least two different colors are within different pixel units.

In this embodiment, in the display period of each image frame, the electrical signals from the light-emitting elements of sub-pixels having at least two different colors are sensed by the sensing lines GC, and the effect of compensating the afterimage may be improved. Since the sensed sub-pixels having at least two different colors are in different pixel units, a distance between every two of the sensed sub-pixels is large in the display period of each image frame, resulting that a macro distribution of the sensed sub-pixels is not excessively concentrated, a sensing noise may be dispersed, an influence of the sensing noise on a sensing value may be reduced, a cross-cut pattern may be avoided from appearing, and a display effect of the display device may be improved. In addition, dispersing of the sensed sub-pixels may cause the heat generated during display by the display device to be dispersed either. The heat generated during the display by the display device is not excessively concentrated, a distribution of the aging caused by the temperature rise may be scattered, therefore further improving the display effect of the display device.

Further, each pixel unit includes sub-pixels having N different colors, wherein N is an integer greater than 1. Sensing electrical signals from light-emitting elements of sub-pixels having at least two different colors by using sensing lines GC within a display period of each image frame, includes: within the display period of each image frame, sensing the electrical signals from the light-emitting elements of the sub-pixels having N different colors in pixel units in a same row, by using the sensing lines GC.

In this way, since within the display period of each image frame, all sub-pixels having different colors in the pixel units in the same row are sensed by using the sensing lines GC, sub-pixels having all colors may be compensated, and the effect of compensating an afterimage may be improved.

In a specific embodiment, the method specifically includes following steps: within the display periods of N image frames, 1) in a display period of a first image frame, sensing an electrical signal from a light-emitting element of a first-color sub-pixel in a (N*k+1)-th pixel unit in a m-th row, an electrical signal from a light-emitting element of a second-color sub-pixel in a (N*k+2)-th pixel unit in the m-th row, . . . , and an electrical signal from a light-emitting element of a (N-th)-color sub-pixel in a (N*k+N)-th pixel unit in the m-th row, wherein k is an integer not less than 0, and m is a positive integer; 2) in a display period of a second image frame, sensing an electrical signal from a light-emitting element of a second-color sub-pixel in a (N*k+1)-th pixel unit in a (m+1)-th row, . . . , an electrical signal from a light-emitting element of a N-th-color sub-pixel in a (N*k+N−1)-th pixel unit in the (m+1)-th row, and an electrical signal from a light-emitting element of a first-color sub-pixel in a (N*k+N)-th pixel unit in the (m+1)-th row; . . . ; 3) in a display period of a p-th image frame, sensing an electrical signal from a light-emitting element of a p-th-color sub-pixel in a (N*k+1)-th pixel unit in a (m+p−1)-th row, . . . , an electrical signal from a light-emitting element of a (p−1+q−1)-th sub-pixel in a (N*k+q)-th pixel unit in the (m+p−1)-th row, and an electrical signal from a light-emitting element of a (p−1)-th-color sub-pixel in a (N*k+N)-th pixel unit in the (m+p−1)-th row, wherein, p and q are integers greater than or equal to 1 and less than or equal to n, and i=0 in a case that p+q≤N+1, and i=N in a case that p+q>N+1; 4) in a display period of a N-th image frame, sensing an electrical signal from a light-emitting element of a N-th-color sub-pixel in a (N*k+1)-th pixel unit in a (m+N−1)-th row, an electrical signal from a light-emitting element of a first-color sub-pixel in a (N*k+2)-th pixel unit in the (m+N−1)-th row, and an electrical signal from a light-emitting element of a (N−1)-th-color sub-pixel in a (N*k+N)-th pixel unit in the (m+N−1)-th row.

In this way, the sensed sub-pixels may be further dispersed so that the sensed sub-pixels are distributed in different columns in the display periods of N image frames, and sub-pixels in a same column are not sensed in the display periods of N image frames, so that the sensing noise may be further scattered, and the influence of the sensing noise to a sensing value is reduced, and the cross-cut pattern may be avoided, thereby improving a display effect of the display device. In addition, heat generated during display of the display device may be further scattered so as not to cause the heat generated during the display of the display device to be concentrated, and thus the aging caused by the temperature rise may be dispersed to further improve the display effect of the display device.

In an specific embodiment, each pixel unit includes a red sub-pixel, a green sub-pixel, a blue sub-pixel, and a white sub-pixel, and the compensation method specifically includes: in display periods of four image frames, 1) in a display period of a first image frame, sensing an electrical signal from a light-emitting element of a red sub-pixel in a (4k+1)-th pixel unit in a m-th row, an electrical signal from a light-emitting element of a green sub-pixel in a (4k+2)-th pixel unit in the m-th row, an electrical signal from a light-emitting element of a blue sub-pixel of a (4k+3)-th pixel unit in the m-th row, and an electrical signal of a light-emitting element of a white sub-pixel in a (4k+4)-th pixel unit in the m-th row; 2) in a display period of a second image frame, sensing an electrical signal from a light-emitting element of a green sub-pixel in a (4k+1)-th pixel unit in a (m+1)-th row, an electrical signal from a light-emitting element of a blue sub-pixel in a (4k+2)-th pixel unit in the (m+1)-th row, an electrical signal from a light-emitting element of a white sub-pixel of a (4k+3)-th pixel unit in the (m+1)-th row, and an electrical signal of a light-emitting element of a red sub-pixel in a (4k+4)-th pixel unit in the (m+1)-th row; 3) in a display period of a third image frame, sensing an electrical signal from a light-emitting element of a blue sub-pixel in a (4k+1)-th pixel unit in a (m+2)-th row, an electrical signal from a light-emitting element of a white sub-pixel in a (4k+2)-th pixel unit in the (m+2)-th row, an electrical signal from a light-emitting element of a red sub-pixel of a (4k+3)-th pixel unit in the (m+2)-th row, and an electrical signal of a light-emitting element of a green sub-pixel in a (4k+4)-th pixel unit in the (m+2)-th row; 4) in a display period of a fourth image frame, sensing an electrical signal from a light-emitting element of a white sub-pixel in a (4k+1)-th pixel unit in a (m+3)-th row, an electrical signal from a light-emitting element of a red sub-pixel in a (4k+2)-th pixel unit in the (m+3)-th row, an electrical signal from a light-emitting element of a green sub-pixel of a (4k+3)-th pixel unit in the (m+3)-th row, and an electrical signal of a light-emitting element of a blue sub-pixel in a (4k+4)-th pixel unit in the (m+3)-th row.

A value of m may be any multiple of N plus 1.

Figure 2:
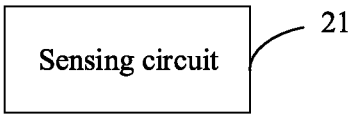
FIG. 2 is a structural block diagram of an apparatus of compensating a display device provided by the present disclosure.

Some embodiments of the present disclosure also provide an apparatus of compensating a display device. The display device includes a plurality of pixel units arranged in multiple rows and multiple columns. Each pixel unit includes a plurality of sub-pixels having different colors, and each sub-pixel includes a pixel driving circuit and a light-emitting element connected to the pixel driving circuit. The pixel driving circuit includes a sensing line GC for sensing an electrical signal from the light-emitting element. As shown in FIG. 2, the apparatus of compensating the display device includes a sensing circuit 21. The sensing circuit 21 is connected to the sensing line GC and configured to sense electrical signals from light-emitting elements of sub-pixels having at least two different colors by using sensing lines corresponding to the sub-pixels having the at least two different colors within a display period of each image frame, wherein the subpixels having at least two different colors are within different pixel units.

In this embodiment, in the display period of each image frame, the electrical signals from the light-emitting elements of sub-pixels having at least two different colors are sensed by the sensing lines GC, and the effect of compensating the afterimage may be improved. Since the sensed sub-pixels having at least two different colors are in different pixel units, a distance between every two of the sensed sub-pixels is large in the display period of each image frame, resulting that a macro distribution of the sensed sub-pixels is not excessively concentrated, a sensing noise may be dispersed, an influence of the sensing noise on a sensing value may be reduced, a cross-cut pattern may be avoided from appearing, and a display effect of the display device may be improved. In addition, dispersing of the sensed sub-pixels may cause the heat generated during display by the display device to be dispersed either. The heat generated during the display by the display device is not excessively concentrated, and a distribution of the aging caused by the temperature rise may be scattered, therefore further improving the display effect of the display device.

Further, each pixel unit includes sub-pixels having N different colors, wherein N is an integer greater than 1.

The sensing circuit is specifically configured to: within the display period of each image frame, sense the electrical signals from the light-emitting elements of the sub-pixels having N different colors in pixel units in a same row, by using the sensing lines GC.

In this way, since within the display period of each image frame, all sub-pixels having different colors in the pixel units in the same row are sensed by using the sensing lines GC, sub-pixels having all colors may be compensated, and the effect of compensating an afterimage may be improved.

In specific embodiments, the sensed sub-pixels may be further dispersed so that the sensed sub-pixels are distributed in different columns in the display periods of N image frames, and sub-pixels in a same column are not sensed in the display periods of N image frames, so that the sensing noise may be further scattered, and the influence of the sensing noise to a sensing value is reduced, and the cross-cut pattern may be avoided, thereby improving a display effect of the display device. In addition, heat generated during display of the display device may be further scattered so as not to cause the heat generated during the display of the display device to be concentrated, and thus the aging caused by the temperature rise may be dispersed to further improve the display effect of the display device.

Further, the sensing circuit is specifically configured to: within the display periods of N image frames, 1) in a display period of a first image frame, sense an electrical signal from a light-emitting element of a first-color sub-pixel in a (N*k+1)-th pixel unit in a m-th row, an electrical signal from a light-emitting element of a second-color sub-pixel in a (N*k+2)-th pixel unit in the m-th row, . . . , and an electrical signal from a light-emitting element of a (N-th)-color sub-pixel in a (N*k+N)-th pixel unit in the m-th row, wherein k is an integer not less than 0, and m is a positive integer; 2) in a display period of a second image frame, sense an electrical signal from a light-emitting element of a second-color sub-pixel in a (N*k+1)-th pixel unit in a (m+1)-th row, . . . , an electrical signal from a light-emitting element of a N-th-color sub-pixel in a (N*k+N−1)-th pixel unit in the (m+1)-th row, and an electrical signal from a light-emitting element of a first-color sub-pixel in a (N*k+N)-th pixel unit in the (m+1)-th row; 3) in a display period of a p-th image frame, sense an electrical signal from a light-emitting element of a p-th-color sub-pixel in a (N*k+1)-th pixel unit in a (m+p−1)-th row, . . . , an electrical signal from a light-emitting element of a (p−1+q−i)-th sub-pixel in a (N*k+q)-th pixel unit in the (m+p−1)-th row, . . . , and an electrical signal from a light-emitting element of a (p−1)-th-color sub-pixel in a (N*k+N)-th pixel unit in the (m+p−1)-th row, wherein, p and q are integers greater than or equal to 1 and less than or equal to n, and i=0 in a case that p+q≤N+1, and i=N in a case that p+q>N+1; . . . ; 4) in a display period of a N-th image frame, sense an electrical signal from a light-emitting element of a N-th-color sub-pixel in a (N*k+1)-th pixel unit in a (m+N−1)-th row, an electrical signal from a light-emitting element of a first-color sub-pixel in a (N*k+2)-th pixel unit in the (m+N−1)-th row, and an electrical signal from a light-emitting element of a (N−1)-th-color sub-pixel in a (N*k+N)-th pixel unit in the (m+N−1)-th row.

In some specific embodiments, each pixel unit includes a red sub-pixel, a green sub-pixel, a blue sub-pixel, and a white sub-pixel. The sensing circuit is specifically configured to: in display periods of four image frames, 1) in a display period of a first image frame, sense an electrical signal from a light-emitting element of a red sub-pixel in a (4k+1)-th pixel unit in a m-th row, an electrical signal from a light-emitting element of a green sub-pixel in a (4k+2)-th pixel unit in the m-th row, an electrical signal from a light-emitting element of a blue sub-pixel of a (4k+3)-th pixel unit in the m-th row, and an electrical signal of a light-emitting element of a white sub-pixel in a (4k+4)-th pixel unit in the m-th row; 2) in a display period of a second image frame, sense an electrical signal from a light-emitting element of a green sub-pixel in a (4k+1)-th pixel unit in a (m+1)-th row, an electrical signal from a light-emitting element of a blue sub-pixel in a (4k+2)-th pixel unit in the (m+1)-th row, an electrical signal from a light-emitting element of a white sub-pixel of a (4k+3)-th pixel unit in the (m+1)-th row, and an electrical signal of a light-emitting element of a red sub-pixel in a (4k+4)-th pixel unit in the (m+1)-th row; 3) in a display period of a third image frame, sense an electrical signal from a light-emitting element of a blue sub-pixel in a (4k+1)-th pixel unit in a (m+2)-th row, an electrical signal from a light-emitting element of a white sub-pixel in a (4k+2)-th pixel unit in the (m+2)-th row, an electrical signal from a light-emitting element of a red sub-pixel of a (4k+3)-th pixel unit in the (m+2)-th row, and an electrical signal of a light-emitting element of a green sub-pixel in a (4k+4)-th pixel unit in the (m+2)-th row; and 4) in a display period of a fourth image frame, sense an electrical signal from a light-emitting element of a white sub-pixel in a (4k+1)-th pixel unit in a (m+3)-th row, an electrical signal from a light-emitting element of a red sub-pixel in a (4k+2)-th pixel unit in the (m+3)-th row, an electrical signal from a light-emitting element of a green sub-pixel of a (4k+3)-th pixel unit in the (m+3)-th row, and an electrical signal of a light-emitting element of a blue sub-pixel in a (4k+4)-th pixel unit in the (m+3)-th row.

The technical solutions of the present disclosure are further described below with reference to the drawings and specific embodiments.

Figure 3:
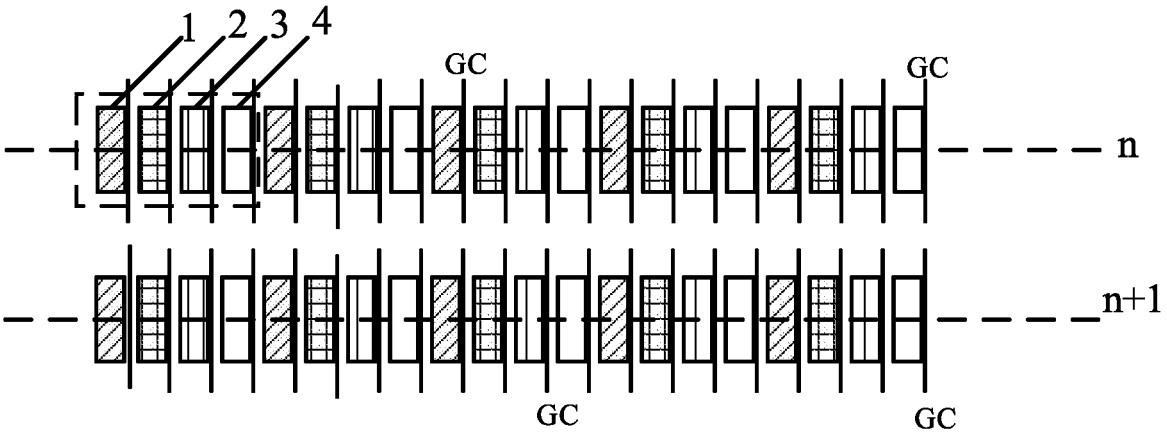
FIG. 3 is a schematic diagram of a sub-pixel arrangement of an OLED display device.

As shown in FIG. 3, each pixel unit of an OLED display device includes a red sub-pixel 1, a green sub-pixel 2, a blue sub-pixel 3, and a white sub-pixel 4.

Figure 4:
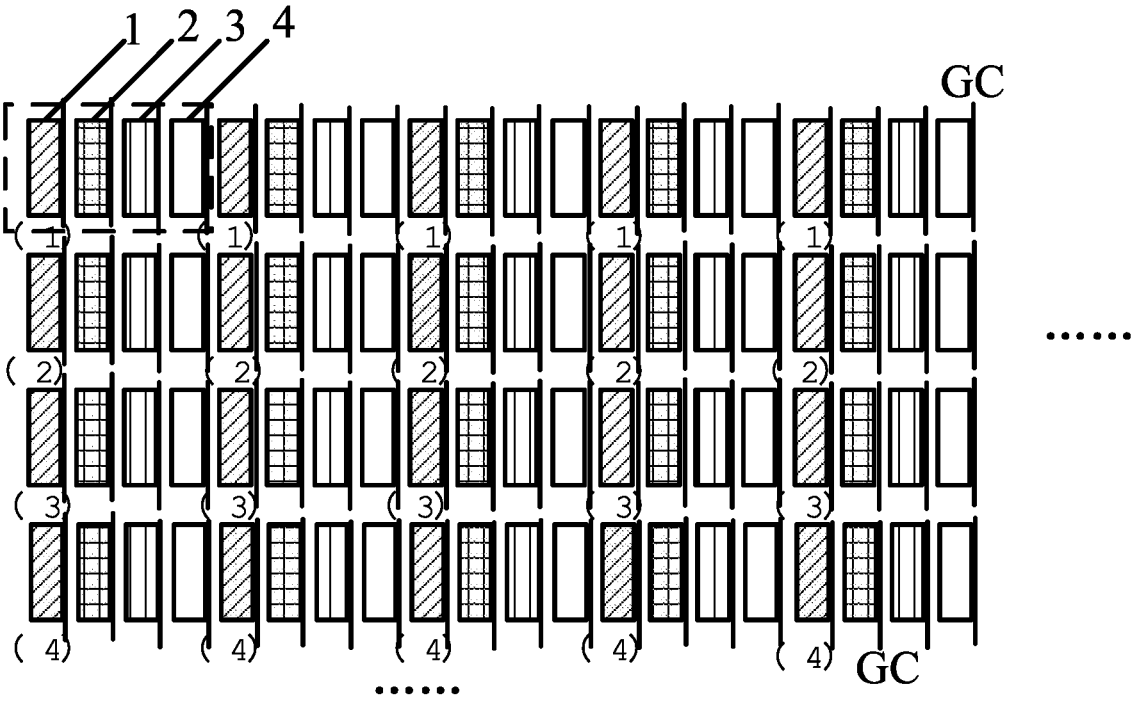
FIG. 4 is a schematic diagram of a sequence of sensing sub-pixels in the related art.

As shown in FIG. 4, when a sub-pixel is to be sensed, red sub-pixels 1 in pixel units in a first row are sensed in a display period of a first image frame (i.e., sub-pixels labeled (1)), red sub-pixels 1 in pixel units in a second row are sensed in a display period of a second image frame (i.e., sub-pixels labeled (2)), red sub-pixels 1 in pixel units in a third row are sensed in a display period of a third image frame (i.e., sub-pixels labeled (3)), and red sub-pixels 1 in pixel units in a fourth row are sensed in a display period of a fourth image frame (i.e., sub-pixels labeled (4)), and so on. After sensing of the red sub-pixels 1 in all rows is finished, sensing of green sub-pixels 2 in pixel units in all rows is started from the first row. After the sensing of the green sub-pixels 2 in pixel units in all rows is finished, sensing of blue sub-pixels 3 in pixel units in all rows is started from the first row. After the sensing of the blue sub-pixels 3 in pixel units in all rows is finished, sensing of white sub-pixels 4 in pixel units in all rows is started from the first row.

Thus, if the display device has 2160 rows of pixel units and a refresh frequency of the display device is 60 Hz, it takes 2160/60=36 s to sense sub-pixels having a same color and 144 seconds are needed to finish sensing of all sub-pixels.

Since sensing of sub-pixels having a same color takes a long time (36 s), the effect of compensating the afterimage is limited. Because a distribution of sub-pixels having a same color is concentrated, the sensed sub-pixels are also concentrated. Thus, noise in a sensing process is also relatively concentrated when an image is switched, and therefore, a sensing value will be influenced, thereby generating a cross-cut pattern and affecting a display effect. Since a duration of sensing sub-pixels having a same color is long, and the distribution of the sensed sub-pixels is concentrated, heat generated when the display device displays is also relatively focused, it is easy for human eyes to recognize aging of a screen caused by a temperature rise, and the display effect may also be affected.

Figure 5:
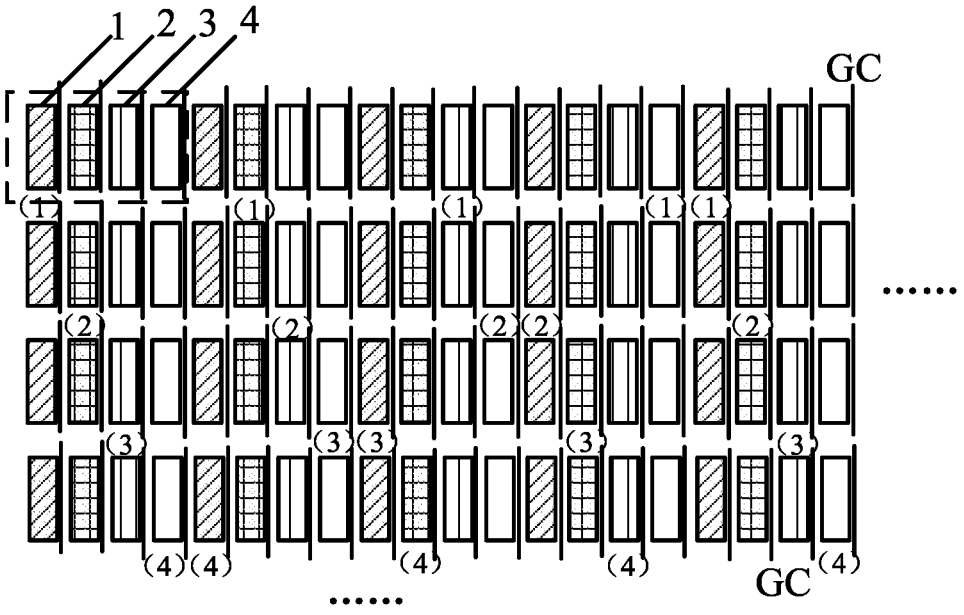
FIG. 5 is a schematic diagram of a sequence of sensing sub-pixels according to some embodiments of the present disclosure.
Figure 6:
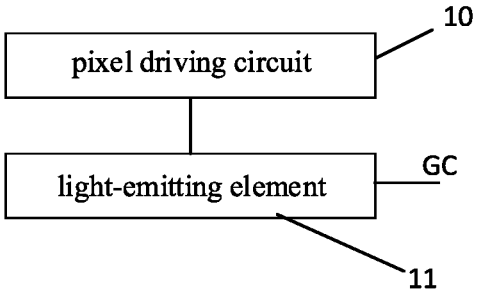
FIG. 6 is a structural block diagram of a pixel driving circuit and a light-emitting element in a sub-pixel provided by the present disclosure.

In order to avoid the above problems, in the embodiments, as shown in FIG. 5, a red sub-pixel 1, a green sub-pixel 2, a blue sub-pixel 3, and a white sub-pixel 4 (i.e., subpixels labelled "(1)") in a (s+1)-th to a (s+4)-th pixel units in a first row are sensed in a display period of a first image frame; since a sensing line GC may sense a sub-pixel in a pixel unit within a display period of an image frame, the sensed red sub-pixel 1, the sensed green sub-pixel 2, the sensed blue sub-pixel 3, and the sensed white sub-pixel 4 are in different pixel units. A green sub-pixel 2, a blue sub-pixel 3, a white sub-pixel 4 and a red sub-pixel 1 (i.e., subpixels labelled "(2)") in a (s+1)-th to a (s+4)-th pixel units in a second row are sensed in a display period of a second image frame; since a sensing line GC may sense a sub-pixel in a pixel unit within a display period of an image frame, the sensed green sub-pixel 2, the sensed blue sub-pixel 3, the sensed white sub-pixel 4, and the sensed red sub-pixel 1 are in different pixel units. A blue sub-pixel 3, a white sub-pixel 4, a red sub-pixel 1 and a green sub-pixel 2 (i.e., subpixels labelled "(3)") in a (s+1)-th to a (s+4)-th pixel units in a third row are sensed in a display period of a third image frame; since a sensing line GC may sense a sub-pixel in a pixel unit within a display period of an image frame, the sensed blue sub-pixel 3, the sensed white sub-pixel 4, the sensed red sub-pixel 1, and the sensed green sub-pixel 2 are in different pixel units. A white sub-pixel 4, a red sub-pixel 1, a green sub-pixel 2, and a blue sub-pixel 3 (i.e., subpixels labelled "(4)") in a (s+1)-th to a (s+4)-th pixel units in a fourth row are sensed in a display period of a fourth image frame. The "s" above is an integer larger than or equal to 0.

In this embodiment, in the display period of each image frame, the electrical signals from the light-emitting elements of sub-pixels having four different colors are sensed by the sensing lines GC, and the effect of compensating the afterimage may be improved. Since a distribution of the sensed sub-pixels is not excessively concentrated, a sensing noise may be dispersed, an influence of the sensing noise on a sensing value may be reduced, a cross-cut pattern may be avoided from appearing, and a display effect of the display device may be improved. In addition, dispersing of the sensed sub-pixels may cause the heat generated during display by the display device to be dispersed either. The heat generated during the display by the display device is not excessively concentrated, a distribution of the aging caused by the temperature rise may be scattered, therefore further improving the display effect of the display device.

Further, in order to further disperse the sensed sub-pixels, the sensed sub-pixels in at least two adjacent rows of pixel units may be in different columns. For example, the sensed sub-pixels in two adjacent rows of pixel units are in different columns, or the sensed sub-pixels in three adjacent rows of pixel units are in different columns; the sensed sub-pixels in four adjacent rows of pixel units are in different columns.

Embodiments of the present disclosure also provide a display device including the apparatus of compensating the display device as described above. The display device may be any product or component having a display function such as a television, a display, a digital photo frame, a mobile phone, a tablet computer, and the like, wherein the display device further includes a flexible circuit board, a printed circuit board, and a back plate.

Embodiments of the present disclosure have the following beneficial effects:

In the above solution, in the display period of each image frame, the electrical signals from the light-emitting elements of sub-pixels having at least two different colors are sensed by the sensing lines GC, and the effect of compensating the afterimage may be improved. Since the sensed sub-pixels having at least two different colors are in different pixel units, a distance between every two of the sensed sub-pixels is large in the display period of each image frame, resulting that a macro distribution of the sensed sub-pixels is not excessively concentrated, a sensing noise may be dispersed, an influence of the sensing noise on a sensing value may be reduced, a cross-cut pattern may be avoided from appearing, and a display effect of the display device may be improved. In addition, dispersing of the sensed sub-pixels may cause the heat generated during display by the display device to be dispersed either. The heat generated during the display by the display device is not excessively concentrated, a distribution of the aging caused by the temperature rise may be scattered, therefore further improving the display effect of the display device.

In the embodiments of the method of the present disclosure, sequence numbers of steps are not used to define a sequence of the steps. A variation in the sequence of the steps is also within the scope of the present disclosure without paying any creative labor by one skilled in the art.

Unless otherwise defined, technical terms or scientific terms used in the present disclosure should be of a general meaning understandable by those of ordinary skills in the art to which the present disclosure pertains. Such words as "first", "second", and the like as used in the present disclosure are not intended to denote any order, number, or importance, but merely to distinguish between different components. Such a word as "including", "comprise", or the like means that an element or item appearing before the word covers an element or item or equivalents thereof appearing after the word, without excluding other elements or items. Such a term as "connecting", "connected", or the like is not limited to a physical connection or a mechanical connection, but may include electrical connections, whether a direct connection or an indirect connection. Such a word as "up", "down", "left", "right" or the like is used only to represent relative positional relationship; when an absolute position of an object being described changes, the relative position relationship also changes.

It will be appreciated that when an element such as a layer, a film, a region, a substrate, or the like is referred to as being "above" or "below" another element, the element may be "directly above" or "directly below" another element, or an intermediate element may be present.

The foregoing are optional embodiments of the present disclosure. It should be noted that, for those of ordinary skills in the art, several modifications and refinements may also be made without departing from the principles of the present disclosure, such modifications and refinements are also to be considered to be in the protection scope of the present disclosure.

What is claimed is:

1. A method of compensating a display device, the display device comprising a plurality of pixel units arranged in multiple rows and multiple columns, each of the plurality of pixel units comprising a plurality of sub-pixels having different colors, and each of the plurality of sub-pixels comprising a pixel driving circuit and a light-emitting element connected to the pixel driving circuit, the pixel driving circuit comprising a sensing line for sensing an electrical signal from the light-emitting element, the method comprising:

sensing electrical signals from light-emitting elements of sub-pixels having at least two different colors by using sensing lines corresponding to the sub-pixels having the at least two different colors within a display period of each image frame, wherein the sub-pixels having the at least two different colors are within different pixel units of the plurality of pixel units;

wherein each of the plurality of pixel units comprises sub-pixels having N different colors, N is an integer greater than 1;

the sensing electrical signals from light-emitting elements of sub-pixels having at least two different colors by using sensing lines corresponding to the sub-pixels having the at least two different colors within a display period of each image frame, comprises: within the display period of each image frame, sensing electrical signals from light-emitting elements of sub-pixels having N different colors in pixel units in a same row, by using sensing lines corresponding to the sub-pixels having N different colors;

wherein, within the display period of each image frame, the sensing electrical signals from light-emitting elements of sub-pixels having N different colors in pixel units in a same row, by using sensing lines corresponding to the sub-pixels having N different colors, specifically comprises:

in a display period of a first image frame in display periods of N image frames, sensing an electrical signal from a light-emitting element of a first-color sub-pixel in a (N*k+1)-th pixel unit in a m-th row, an electrical signal from a light-emitting element of a second-color sub-pixel in a (N*k+2)-th pixel unit in the m-th row, . . . , to an electrical signal from a light-emitting element of a (N-th)-color sub-pixel in a (N*k+N)-th pixel unit in the m-th row, wherein k is an integer not less than 0, and m is a positive integer;

in a display period of a second image frame in the display periods of the N image frames, sensing an electrical signal from a light-emitting element of a second-color sub-pixel in a (N*k+1)-th pixel unit in a (m+1)-th row, . . . , to an electrical signal from a light-emitting element of a N-th-color sub-pixel in a (N*k+N−1)-th pixel unit in the (m+1)-th row, to an electrical signal from a light-emitting element of a first-color sub-pixel in a (N*k+N)-th pixel unit in the (m+1)-th row;

in a display period of a p-th image frame in the display periods of the N image frames, sensing an electrical signal from a light-emitting element of a p-th-color sub-pixel in a (N*k+1)-th pixel unit in a (m+p−1)-th row, . . . , to an electrical signal from a light-emitting element of a (p−1+q-i)-th sub-pixel in a (N*k+q)-th pixel unit in the (m+p−1)-th row, . . . , to an electrical signal from a light-emitting element of a (p−1)-th-color sub-pixel in a (N*k+N)-th pixel unit in the (m+p−1)-th row, wherein, p and q are integers greater than or equal to 1 and less than or equal to n, and i=0 in a case that p+q N+1, and i=N in a case that p+q>N+1; and in a display period of a N-th image frame in the display periods of the N image frames, sensing an electrical signal from a light-emitting element of a N-th-color sub-pixel in a (N*k+1)-th pixel unit in a (m+N−1)-th row, an electrical signal from a light-emitting element of a first-color sub-pixel in a (N*k+2)-th pixel unit in the (m+N−1)-th row, . . . , to an electrical signal from a light-emitting element of a (N−1)-th-color sub-pixel in a (N*k+N)-th pixel unit in the (m+N−1)-th row.

2. The method according to claim 1, wherein each of the plurality of pixel units comprises a red sub-pixel, a green sub-pixel, a blue sub-pixel, and a white sub-pixel, the method specifically comprises:

in a display period of a first image frame in display periods of four image frames, sensing an electrical signal from a light-emitting element of a red sub-pixel in a (4k+1)-th pixel unit in a m-th row, an electrical signal from a light-emitting element of a green sub-pixel in a (4k+2)-th pixel unit in the m-th row, an electrical signal from a light-emitting element of a blue sub-pixel of a (4k+3)-th pixel unit in the m-th row, and an electrical signal of a light-emitting element of a white sub-pixel in a (4k+4)-th pixel unit in the m-th row;

in a display period of a second image frame in the display periods of the four image frames, sensing an electrical signal from a light-emitting element of a green sub-pixel in a (4k+1)-th pixel unit in a (m+1)-th row, an electrical signal from a light-emitting element of a blue sub-pixel in a (4k+2)-th pixel unit in the (m+1)-th row, an electrical signal from a light-emitting element of a white sub-pixel of a (4k+3)-th pixel unit in the (m+1)-th row, and an electrical signal of a light-emitting element of a red sub-pixel in a (4k+4)-th pixel unit in the (m+1)-th row;

in a display period of a third image frame in the display periods of the four image frames, sensing an electrical signal from a light-emitting element of a blue sub-pixel in a (4k+1)-th pixel unit in a (m+2)-th row, an electrical signal from a light-emitting element of a white sub-pixel in a (4k+2)-th pixel unit in the (m+2)-th row, an electrical signal from a light-emitting element of a red sub-pixel of a (4k+3)-th pixel unit in the (m+2)-th row, and an electrical signal of a light-emitting element of a green sub-pixel in a (4k+4)-th pixel unit in the (m+2)-th row;

in a display period of a fourth image frame in the display periods of the four image frames, sensing an electrical signal from a light-emitting element of a white sub-pixel in a (4k+1)-th pixel unit in a (m+3)-th row, an electrical signal from a light-emitting element of a red sub-pixel in a (4k+2)-th pixel unit in the (m+3)-th row, an electrical signal from a light-emitting element of a green sub-pixel of a (4k+3)-th pixel unit in the (m+3)-th row, and an electrical signal of a light-emitting element of a blue sub-pixel in a (4k+4)-th pixel unit in the (m+3)-th row.

3. The method according to claim 1, wherein a value of m may be any multiple of N plus 1.

4. The method according to claim 1, wherein the sensed sub-pixels in two adjacent rows of pixel units are in different columns, or the sensed sub-pixels in three adjacent rows of pixel units are in different columns; or the sensed sub-pixels in four adjacent rows of pixel units are in different columns.

5. An apparatus of compensating a display device, the display device comprising a plurality of pixel units arranged in multiple rows and multiple columns, each of the plurality of pixel units comprising a plurality of sub-pixels having different colors, and each of the plurality of sub-pixels comprising a pixel driving circuit and a light-emitting element connected to the pixel driving circuit, the pixel driving circuit comprising a sensing line for sensing an electrical signal from the light-emitting element, the apparatus comprising:

a sensing circuit, connected to the sensing line and configured to sense electrical signals from light-emitting elements of sub-pixels having at least two different colors by using sensing lines corresponding to the sub-pixels having the at least two different colors within a display period of each image frame, wherein the sub-pixels having the at least two different colors are within different pixel units of the plurality of pixel units;

wherein each of the plurality of pixel units comprises sub-pixels having N different colors, N is an integer greater than 1;

the sensing circuit is specifically configured to: within the display period of each image frame, sense electrical signals from light-emitting elements of sub-pixels having N different colors in pixel units in a same row, by using sensing lines corresponding to the sub-pixels having N different colors;

wherein, the sensing circuit is specifically configured to:

in a display period of a first image frame in display periods of N image frames, sense an electrical signal from a light-emitting element of a first-color sub-pixel in a (N*k+1)-th pixel unit in a m-th row, an electrical signal from a light-emitting element of a second-color sub-pixel in a (N*k+2)-th pixel unit in the m-th row, . . . , to an electrical signal from a light-emitting element of a (N-th)-color sub-pixel in a (N*k+N)-th pixel unit in the m-th row, wherein k is an integer not less than 0, and m is a positive integer;

in a display period of a second image frame in the display periods of the N image frames, sense an electrical signal from a light-emitting element of a second-color sub-pixel in a (N*k+1)-th pixel unit in a (m+1)-th row, . . . , to an electrical signal from a light-emitting element of a N-th-color sub-pixel in a (N*k+N−1)-th pixel unit in the (m+1)-th row, to an electrical signal from a light-emitting element of a first-color sub-pixel in a (N*k+N)-th pixel unit in the (m+1)-th row;

in a display period of a p-th image frame in the display periods of the N image frames, sense an electrical signal from a light-emitting element of a p-th-color sub-pixel in a (N*k+1)-th pixel unit in a (m+p−1)-th row, . . . , to an electrical signal from a light-emitting element of a (p−1+q-i)-th sub-pixel in a (N*k+q)-th pixel unit in the (m+p−1)-th row, . . . , to an electrical signal from a light-emitting element of a (p−1)-th-color sub-pixel in a (N*k+N)-th pixel unit in the (m+p−1)-th row, wherein, p and q are integers greater than or equal to 1 and less than or equal to n, and i=0 in a case that p+q N+1, and i=N in a case that p+q>N+1, and in a display period of a N-th image frame in the display periods of the N image frames, sense an electrical signal from a light-emitting element of a N-th-color sub-pixel in a (N*k+1)-th pixel unit in a (m+N−1)-th row, an electrical signal from a light-emitting element of a first-color sub-pixel in a (N*k+2)-th pixel unit in the (m+N−1)-th row, . . . , to an electrical signal from a light-emitting element of a (N−1)-th-color sub-pixel in a (N*k+N)-th pixel unit in the (m+N−1)-th row.

6. The apparatus according to claim 5, wherein each of the plurality of pixel units comprises a red sub-pixel, a green sub-pixel, a blue sub-pixel, and a white sub-pixel, the sensing circuit is specifically configured to:

in a display period of a first image frame in display periods of four image frames, sense an electrical signal from a light-emitting element of a red sub-pixel in a (4k+1)-th pixel unit in a m-th row, an electrical signal from a light-emitting element of a green sub-pixel in a (4k+2)-th pixel unit in the m-th row, an electrical signal from a light-emitting element of a blue sub-pixel of a (4k+3)-th pixel unit in the m-th row, and an electrical signal of a light-emitting element of a white sub-pixel in a (4k+4)-th pixel unit in the m-th row;

in a display period of a second image frame in the display periods of the four image frames, sense an electrical signal from a light-emitting element of a green sub-pixel in a (4k+1)-th pixel unit in a (m+1)-th row, an electrical signal from a light-emitting element of a blue sub-pixel in a (4k+2)-th pixel unit in the (m+1)-th row, an electrical signal from a light-emitting element of a white sub-pixel of a (4k+3)-th pixel unit in the (m+1)-th row, and an electrical signal of a light-emitting element of a red sub-pixel in a (4k+4)-th pixel unit in the (m+1)-th row;

in a display period of a third image frame in the display periods of the four image frames, sense an electrical signal from a light-emitting element of a blue sub-pixel in a (4k+1)-th pixel unit in a (m+2)-th row, an electrical signal from a light-emitting element of a white sub-pixel in a (4k+2)-th pixel unit in the (m+2)-th row, an electrical signal from a light-emitting element of a red sub-pixel of a (4k+3)-th pixel unit in the (m+2)-th row, and an electrical signal of a light-emitting element of a green sub-pixel in a (4k+4)-th pixel unit in the (m+2)-th row;

in a display period of a fourth image frame in the display periods of the four image frames, sense an electrical signal from a light-emitting element of a white sub-pixel in a (4k+1)-th pixel unit in a (m+3)-th row, an electrical signal from a light-emitting element of a red sub-pixel in a (4k+2)-th pixel unit in the (m+3)-th row, an electrical signal from a light-emitting element of a green sub-pixel of a (4k+3)-th pixel unit in the (m+3)-th row, and an electrical signal of a light-emitting element of a blue sub-pixel in a (4k+4)-th pixel unit in the (m+3)-th row.

7. The apparatus according to claim 6, wherein the sensed sub-pixels in two adjacent rows of pixel units are in different columns, or the sensed sub-pixels in three adjacent rows of pixel units are in different columns; or the sensed sub-pixels in four adjacent rows of pixel units are in different columns.

8. A display device, comprising:

the apparatus of compensating the display device according to the claim 5.

* * * * *